United States Patent [19]

Mergner et al.

[11] 4,073,987

[45] Feb. 14, 1978

[54] MULTI-LAYER FRONT PLATE FOR FURNITURE AND METHOD OF MAKING SAME

[75] Inventors: Dietrich Mergner, Magstadt; Heinz Stege, Stuttgart, both of Germany

[73] Assignee: Bauknecht Gesellschaft mit beschrankter Haftung Elektrotechnische Fabriken, Stuttgart, Germany

[21] Appl. No.: 620,390

[22] Filed: Oct. 7, 1975

[30] Foreign Application Priority Data

Oct. 8, 1974 Germany ..... 2447873

[51] Int. Cl.[2] ..... B32B 3/26

[52] U.S. Cl. ..... 428/81; 428/76; 428/151; 428/157; 428/158; 428/314; 428/315; 428/425

[58] Field of Search ..... 428/310, 313, 314, 315, 428/81, 71, 158, 68, 159, 76, 160, 316, 317, 425, 151, 157; 264/46.4, 46.6, 46.7; 49/501, 506

[56] References Cited

U.S. PATENT DOCUMENTS

| | | | |
|---|---|---|---|
| 3,091,551 | 5/1963 | Robertson | 428/313 |
| 3,223,576 | 12/1965 | Evans et al. | 428/317 |
| 3,431,331 | 3/1969 | Pincus et al. | 264/45 |
| 3,496,043 | 2/1970 | Ragan | 428/315 |
| 3,528,872 | 9/1970 | Scholl et al. | 428/310 |
| 3,671,355 | 6/1972 | Paymal | 428/310 |
| 3,676,278 | 7/1972 | Stewart | 428/310 |
| 3,755,031 | 8/1973 | Hoffman | 428/310 |
| 3,772,129 | 11/1973 | Dover | 428/313 |
| 3,790,421 | 2/1974 | Habgood, Jr. | 428/310 |
| 3,907,624 | 9/1975 | Gravely, Jr. | 428/81 |
| 3,961,118 | 6/1976 | Michaelis | 428/158 |

*Primary Examiner*—William J. Van Balen
*Attorney, Agent, or Firm*—Walter Becker

[57] ABSTRACT

A multi-layer front plate for furniture, especially, but not exclusively, for kitchen cabinet doors, and method of making same, according to which a core plate, preferably of pressed material, has its front side and its confining edges covered with a synthetic material, especially with a soft integral foam of polyurethane or another elastomeric material, while those sections of the cover where the front side of the cover merges with the cover edges include a rounded section.

9 Claims, 5 Drawing Figures

MULTI-LAYER FRONT PLATE FOR FURNITURE AND METHOD OF MAKING SAME

The present invention relates to a multi-layer front plate for furniture, especially a front plate as a suitable for a door of kitchen furniture, said front plate being provided with a core plate preferably designed as a plate of pressed chip material, pressed shavings, or plywood.

With heretofore known front plates, especially for the manufacture of kitchen furniture, the confining edges are cut so sharply that there exists the danger of injuries if somebody's head should accidentally hit an open upper cupboard door of the above mentioned design or should with his legs hit an open lower cupboard door of this type. With the manufacture of one layer as well as multi-layer front plates, considerable costs are involved when such front plates after being cut with their confining edges have to be rounded off to such an extent that the above mentioned danger of injuries can at least nearly be avoided.

It is, therefore, an object of the present invention to provide a multi layer front plate for the above mentioned purpose, the outer edges of which are so rounded that the above mentioned danger of injuries will be safely avoided.

This object and other objects and advantages of the invention will appear more clearly from the following specification in connection with the accompanying drawing, in which.

Figure 1:
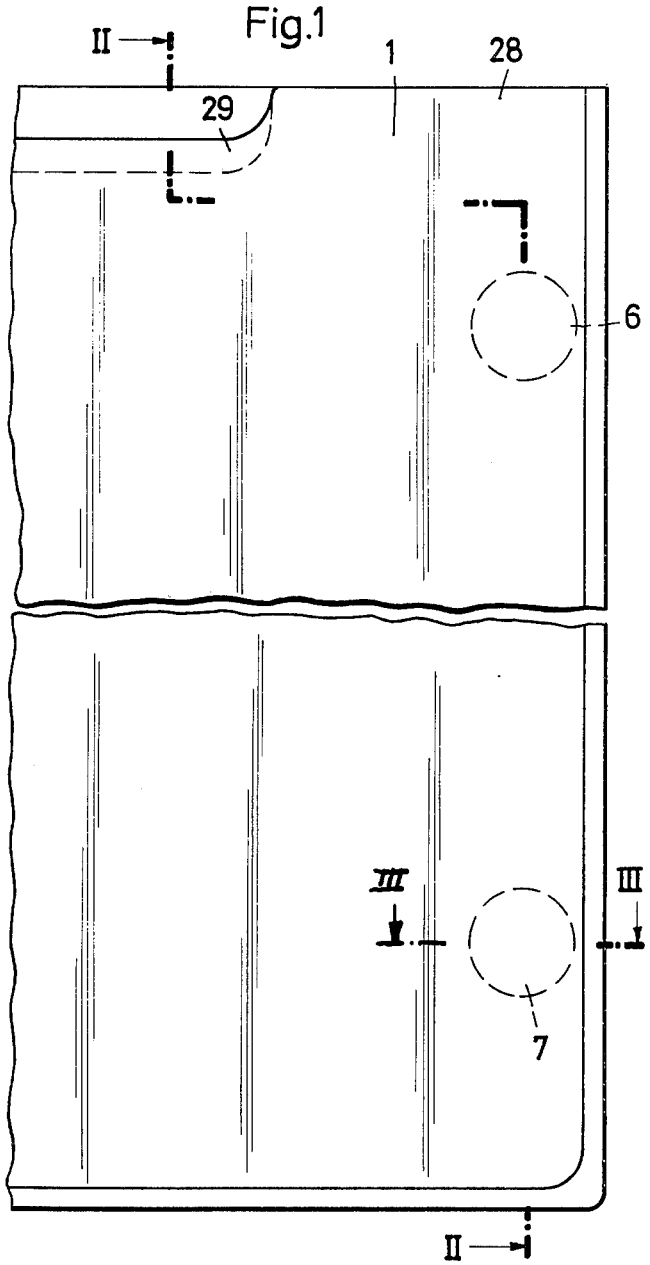
FIG. 1 shows a view of a portion of the front plate according to the invention as seen from its front side.
Figure 2:
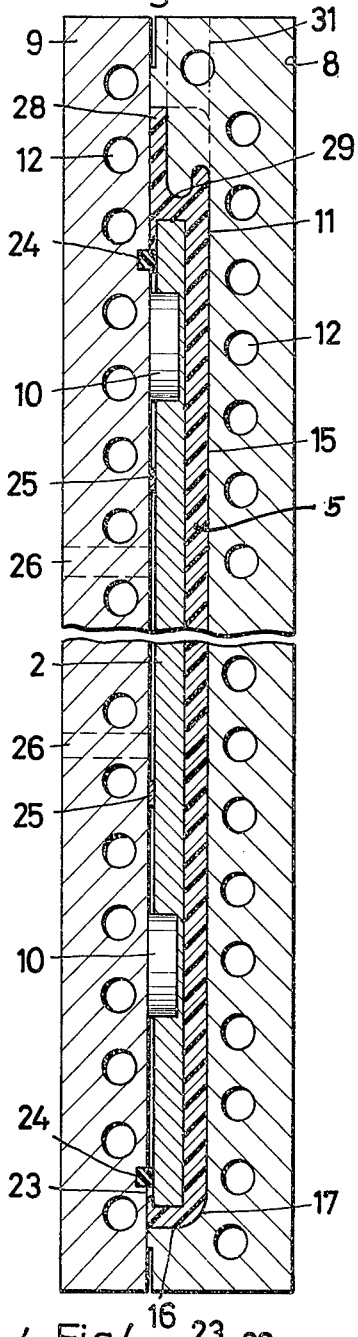
FIG. 2 represents a section taken along the line II—II of FIG. 1 while also showing in section a foaming mold for use in connection with the making of such front plate.

The multi-layer front plate according to the present invention which is provided with a core plate is characterized primarily in that the core plate has its front side and its confining edges provided with a foamed cover of synthetic material, especially with a soft integral foam of polyurethane or another elastomer which is rounded where the front side merges with its edges. Advantageously, the rounded portion may be so designed that it merges tangentially with an edge surface extending perpendicularly with regard to the front side while with the front side forming an acute angle which is less than 60°. This cutting angle is formed by a plane which forms an extension of the front side, and by a tangential plane which in the cutting edge formed by the rounding with the front side extends along said rounded portion.

According to a further development of the invention, the cover may over the edges of the core plate extend up to the back side of the front plate and here may form a projection with regard to the core plate. Such projection may preferably have a width of about 3 mm and a thickness of from about 0.2 to 0.5 mm, preferably 0.3 mm.

The advantage of the design of the front plate according to the invention consists in that when employing said front plate as furniture door, it will permit a quiet closing. During the closing operation, there will also be avoided the danger of injuring fingers by clamping same between the door and the cupboard. Moreover, the coat of soft integral foam applied to the core plate brings about the advantage that the coat itself when impacting upon a hard subject, as for instance a cooking pot or a coffee can or sharp-edged subject as for instance a fork or kitchen knife, will not suffer any permanent damage, nor will actual damage remain visible. A slight depression in the coat according to the invention will smooth itself out after a short time. Also a cut or tear closes automatically.

In order to avoid the danger that the coat of foamed material will discolor under the influence of light, it is suggested according to a further development of the invention that the surface side of the coat and the rounded portions which extend over the edges of the core plate are coated up to the plane of the back side with a two-component dye lacquer, a so-called DD-lacquer, also known and sold under the trade name "Desmodur" which is a desmophene reaction lacquer, also known as polyurethane reaction lacquer or two-component catalized paint. One of the components usually is a polyalcohol whereas the other component is an isocyanate.

In order to increase the adherence of the foamed up cover on the edges of the core plate, it is suggested, according to a further development of the invention, to cut a groove preferably closed in itself into the edge surfaces of the core plate. The coat which extends over the edges is anchored in said groove, or a folded-over part may be provided which extends toward the inside of the door and is anchored in said groove. The edge surface of the plates may be enlarged by coarse teeth.

For purposes of producing and foaming up the coat onto the core plate, it is possible in a manner known per se to use a tempered steel mold. In this connection, it is advisable according to a further development of the invention that the foam mold which fixes and receives the core plate has its inner surface coated with a separating substance prior to inserting the core plate. The purposes of this separating substance consists in facilitating the removal of the formed part from the mold. Such separating substance, also called release parting agent, consists primarily of a combination of metal soap and wax. If it is desired in the above mentioned manner that the cover has its surface and the rounded sections extending over the edges of the core plate up to the plane of the rear side of the core plate provided with a dye lacquer, espeically with a DD-lacquer, it is possible according to a further development of the invention that the dye lacquer designed as cover layer for the formed layer be applied to the separating layer already introduced into the foam mold. This application may be effected by spraying.

Figure 3:
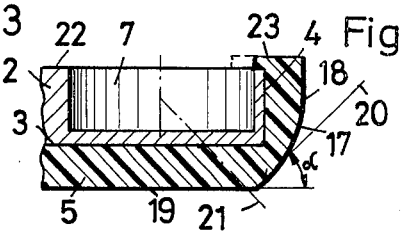
FIG. 3 represents a section taken along the line III—III in FIG. 1 but on a larger scale than that of FIG. 1.

Referring now to the drawing in detail, the front plate 1 showing its front side is designed as assembly ready kitchen furniture door, and according to the cross section illustrated in FIG. 3 comprises a plate 2 of pressed shaving material or the like. This plate 2, henceforth called the core plate, is at its front side 3 and along its confining edges 4 produced when the door is being cut, provided with a continuous cover or coat 5 of foamed up polyurethane soft foam. Along the longitudinal edges of the front plate which in the position of use as kitchen furniture door are standing vertically, the core plate 2 of the front plate has four bores 6 and 7 forming blind holes. Of these bores, the drawing shows only the two bores 6 and 7 which for a right hand abutment of the kitchen furniture door is provided for receiving the non-illustrated hinges. The two other blind bores are provided for left hand abutment. The respectively non-occupied two blind bores are closed by a closure member of synthetic material which closure member is not shown in the drawing.

Prior to the application of the soft integral foam which forms the cover 5, the plate 2 is at both front and rear surface sides is provided with a synthetic resin cover layer of melamine resin whereby the adherence of the polyurethane foam to the cover layer and thus to the overall connection is considerably improved. Furthermore, the melamine resin layer serves as resistance against warping and simultaneously as the surface of the inner side of the door.

For purposes of applying the cover 5, there is provided a two-sectional molding form of steel which comprises a bottom member 8 and a cover member 9. This cover member has four flat centering cylinders 10 each of which is received in one of the blind bores 6 and 7 respectively, and then the plate 2 is fixed in the inner hollow chamber 11 of the bottom member 8 during the foaming-up process.

The bottom member 8 as well as the cover part 9 comprises numerous tempering passages 12 which are passed through by a tempering medium serving as heat carrier, preferably water, while care is taken that the exothermic heat reaction occurs in a controlled manner.

The inner wall 15 which defines the hollow chamber 11 in the bottom member 8 extends at a distance of approximately 6 mm parallel with regard to the front side of plate 2 which is to be provided with the coat 5 having a thickness of at least 4 mm or specifically 6 mm and within the region of the side edges 4 and the lower edge 6 of the plate 2 according to FIG. 3 merges with a cylinder shaped rounded section 17 and extends tangentially into the edge surfaces 18 for the cover 5. The rounded section 17 intersects with the front side 19 which is fixed by the inner wall 15 of the bottom member 8. More specifically, according to FIG. 3 the rounded section 17 intersects with the front side 19 at an angle $\alpha$ of approximately 45°. This angle $\alpha$ is enclosed by the plane which is not shown in detail and forms an extension of the front side 19, and is furthermore enclosed by a tangential plane 20.

The plane 20 is in the intersecting edge 21 located at the rounded section 17.

In order to assure a positive connection of the cover 5 with the plate 2, the cover 5 extends beyond the lateral edges 4 up to the back side 22 of the plate 2 and here forms a projection 23 which at a width of approximately 3 mm extends over the back side 22 and has a thickness of approximately 0.3 mm. The coat has a width of from 2.8 to 3.2 mm and a thickness of from 0.2 to 0.5 mm. For purposes of generating this projection 23, a continuous sealing strip 24 is inserted into the cover part 9 of the foaming mold. The said sealing strip 24 projects beyond the plane end face of the cover member to such an extent that the plate 2 which is mounted prior to the foaming operation can be kept at a distance from the cover part as it is necessary for the thickness of the projection 23. For the same purposes there are employed a plurality of interrupted spacer strips 25 which are placed upon the cover part 9 and which are also placed upon the end face of the cover part 9 and leave free among themselves so many distances or spaces that prior to the foaming-up operation the air which has accumulated in the inner chamber 11 of the molding form can be withdrawn through vacuum passages 26.

At the edge zone 28 which is formed by the soft foam material and which projects beyond the plate 2 in upward direction, a depression 29 has been provided for handling. This depression 29 extends, however, only beyond the central zone of the front plate and makes superfluous the placing of otherwise customary handles. In order to be able to recess said depression, a slide 31 indicated by dot-dash lines is provided in the bottom member 8. This slide can for purposes of withdrawing the front plate which is usable without further machining after completion of the foaming-up operation, be withdrawn from the bottom member 8.

In order after the completion of the foaming-up operation to make the withdrawal of the front plate 1 from the bottom member 8 easier, it is provided according to the method of the present invention that the inner wall 15, prior to the insertion of the plate 2 fixed onto the cover part 9, be sprayed with a separating lacquer e.g. polyvinyl alcohol or the above mentioned release parting agent customary for these purposes. Moreover, according to the method of the present invention, it is provided that a dye lacquer is applied to said separating lacquer, which dye lacquer during the foaming-up operation bonds with the soft integral foam and protects the same against a possible influence of light and the discoloration caused thereby. By "dye lacquer" is meant the above mentioned DD-lacquer to which have been added dye pigments. In this way, it is possible to save a later lacquering of the finished foamed front plate 1. Independently thereof, the inner wall 15 of the bottom member 8 of the foaming mold may be provided with a profile pattern or the like which during the foaming-up operation is conveyed to the cover 5 and will be visible on the front side 19 thereof.

Figure 4:
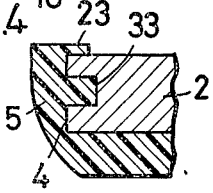
FIG. 4 shows a modification of a front plate along a section similar to that of FIG. 3.

According to the embodiment illustrated in cross section in FIG. 4, it will be appreciated that in addition to the projection 23, for a positive connection of the foam material cover 5 a groove 33 is cut into the lateral edge 4 of plate 2. In this groove 33, during the foaming-up operation, the coat 5 will anchor itself to such an extent that it positively connects to the plate 2 and similar to the above mentioned embodiments will not require any post treatment when the front plate provided with the foamed cover 5 has been withdrawn from the foam mold.

Figure 5:
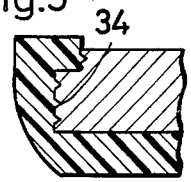
FIG. 5 is still another modification along a section similar to that of FIG. 3.

According to the embodiment illustrated in cross section in FIG. 5, in addition to the projection 23, there is for purposes of creating a positive connection of the foamed cover 5 a closed groove 34 cut into the lateral edge 4 of plate 2. The lateral edge is for purposes of increasing its surface provided with toothed recesses in which during the foaming operation, the coat 5 can anchor itself in such a way that it will intimately bond to the plate 2 whereby, as described in connection with the above outlined designs, no further working operation is required when the front plate provided with the foamed cover 5 is being withdrawn from the foam mold.

It is, of course, to be understood that the present invention is, by no means, limited to the specific showing in the drawing but also comprises any modifications within the scope of the appended claims.

What we claim is:

1. A multi-layer front door plate for furniture, especially for kitchen cabinet doors, which includes in combination: a core plate of pressed chip material having a front side and a smooth rear side both coated with a synthetic resin and having plate defining edges, and a coat of soft integral foamed synthetic material arranged only on said resin coated front side and surrounding said plate defining edges to preclude all sharpness thereof and comprising a transitioned rounded section where said front side merges with said edges also covered with said coat of soft integral foamed synthetic material, the rear side except for edges being free of foamed synthetic material so that only the synthetic resin coats the rear side.

2. A front plate for furniture in combination according to claim 1, in which said foamed coat is of a soft integral foam of polyurethane.

3. A front plate for furniture in combination according to claim 1, in which said synthetic resin is a melamine resin.

4. A front plate for furniture in combination according to claim 1, in which said plate defining edges include side edges, and in which said foamed coat extends beyond said side edges to the rear side of said core plate and projects beyond said core plate, said coat having a width of from 2.8 to 3.2 mm and a thickness of from 0.2 to 0.5 mm.

5. A front plate for furniture in combination according to claim 4, in which said foamed coat on said front side of said core plate has a thickness of at least 4 mm.

6. A front plate for furniture in combination according to claim 4, in which said foamed coat on said front side of said core plate has a thickness of 6 mm.

7. A front plate for furniture in combination according to claim 1, in which said foamed coat has its surface opposite the resin coat and its rounded sections extending over said side edges covered up to the plane of said rear side of said core plate by a dye lacquer.

8. A front plate for furniture in combination according to claim 7, in which said dye lacquer is a two-component catalized lacquer paint.

9. A front plate for furniture in combination according to claim 1, in which said side edges are provided with groove means having the foamed coat portion anchored therein which extends over said groove means.

* * * * *